US009725282B2

(12) United States Patent
Miller et al.

(10) Patent No.: US 9,725,282 B2
(45) Date of Patent: Aug. 8, 2017

(54) ELEVATOR LOAD BEARING ASSEMBLY INCLUDING DIFFERENT SIZED LOAD BEARING MEMBERS

(75) Inventors: Robin Mihekun Miller, Canton, CT (US); Richard N. Fargo, Plainville, CT (US); Boris Traktovenko, Avon, CT (US); James Leo Hubbard, Kensington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1114 days.

(21) Appl. No.: 12/090,379

(22) PCT Filed: Nov. 2, 2005

(86) PCT No.: PCT/US2005/039527

§ 371 (c)(1),
(2), (4) Date: Apr. 16, 2008

(87) PCT Pub. No.: WO2007/053138

PCT Pub. Date: May 10, 2007

(65) Prior Publication Data

US 2008/0202864 A1 Aug. 28, 2008

(51) Int. Cl.
*B66B 7/10* (2006.01)
*B66B 7/06* (2006.01)
(Continued)

(52) U.S. Cl.
CPC ..... *B66B 7/085* (2013.01); *B66B 7/062* (2013.01); *B66B 7/10* (2013.01)

(58) Field of Classification Search
CPC ..... B66B 7/062; B66B 7/085; B66B 7/10
(Continued)

(56) References Cited

U.S. PATENT DOCUMENTS 1,035,230 A * 8/1912 Pearson ..... 187/254
1,700,587 A * 1/1929 Higbee ..... 187/412
(Continued)

FOREIGN PATENT DOCUMENTS

EP 1325881 A1 7/2003
EP 1334943 B1 3/2011
(Continued)

OTHER PUBLICATIONS

International Search Report and Written Opinion of the International Searching Authority for International application No. PCT/US05/39527 mailed Sep. 27, 2006.
(Continued)

*Primary Examiner* — William A Rivera
*Assistant Examiner* — Stefan Kruer
(74) *Attorney, Agent, or Firm* — Carlson, Gaskey & Olds

(57) ABSTRACT

An elevator system (20) load bearing assembly (30) includes a plurality of load bearing members (32-38). At least one of the load bearing members (32-38) has a load carrying capacity that is different than at least one other of the load bearing members (32-38). A disclosed example includes equal numbers of load bearing members (32, 38) having a first load carrying capacity and equal numbers of load bearing members (34, 36) having a second, different load carrying capacities. Another example includes at least three different load carrying capacities. With the disclosed examples, the aggregate load carrying capacity of an elevator load bearing assembly (30) can more closely meet the load carrying requirements for a given elevator system without over-roping the system.

3 Claims, 3 Drawing Sheets

(51) Int. Cl.
*B66B 11/08* (2006.01)
*B66B 7/08* (2006.01)

(58) Field of Classification Search
USPC ..... 187/251, 254, 264, 266, 411, 412, 249, 187/291, 902
IPC ..... B66B 11/08,15/02, 7/06; F16G 1/16, 1/28, 9/04; D07B 1/22
See application file for complete search history.

(56) References Cited

U.S. PATENT DOCUMENTS

| | | | | |
|---|---|---|---|---|
| 2,148,123 | A * | 2/1939 | Hymans | 187/411 |
| 5,149,922 | A * | 9/1992 | Kondou | 187/392 |
| 5,611,412 | A | 3/1997 | Yoo et al. | |
| 6,068,087 | A * | 5/2000 | Moncini | 187/252 |
| 6,223,862 | B1 | 5/2001 | Barnes | |
| 6,364,061 | B2 * | 4/2002 | Baranda et al. | 187/254 |
| 6,364,063 | B1 | 4/2002 | Aulanko et al. | |
| 6,386,324 | B1 * | 5/2002 | Baranda et al. | 187/254 |
| 6,397,974 | B1 * | 6/2002 | Adifon et al. | 187/254 |
| 6,488,123 | B2 | 12/2002 | Pitts et al. | |
| 6,508,051 | B1 | 1/2003 | De Angelis | |
| 6,672,046 | B1 * | 1/2004 | Prewo et al. | 57/232 |
| 6,739,433 | B1 * | 5/2004 | Baranda et al. | 187/411 |
| 6,837,340 | B2 | 1/2005 | Strauss et al. | |
| 2002/0046908 | A1 * | 4/2002 | Strauss et al. | 187/411 |
| 2002/0056593 | A1 * | 5/2002 | Adifon et al. | 187/254 |
| 2003/0092524 | A1 * | 5/2003 | Baranda et al. | 474/266 |
| 2005/0087404 | A1 * | 4/2005 | Barrett et al. | 187/411 |

FOREIGN PATENT DOCUMENTS

| | | | | |
|---|---|---|---|---|
| JP | 466489 | | 3/1992 | |
| JP | 04080188 | A * | 3/1992 | B66B 7/06 |
| JP | 539181 | | 2/1993 | |
| JP | 10236753 | A * | 9/1998 | B66B 11/02 |
| JP | 2000118911 | A | 4/2000 | |
| WO | WO 0114630 | A1 * | 3/2001 | D07B 1/00 |

OTHER PUBLICATIONS

International Preliminary Report on Patentability for International application No. PCT/US05/39527 mailed Jun. 5, 2007.
Extended European Search Report for Application No. EP 05 82 4891 dated Aug. 10, 2011.

* cited by examiner

ELEVATOR LOAD BEARING ASSEMBLY INCLUDING DIFFERENT SIZED LOAD BEARING MEMBERS

FIELD OF THE INVENTION

This invention generally relates to elevator systems. More particularly, this invention relates to load bearing assemblies for elevator systems.

DESCRIPTION OF THE RELATED ART

Elevator systems are in widespread use and take a variety of forms. Many elevator systems include an elevator car and a counterweight that are coupled together by a load bearing assembly. Traditionally, steel ropes were used for coupling the car and counterweight and supporting the load of each to provide the desired movement of the elevator car. More recently, alternative load bearing members have been proposed. One example includes a flat belt including a plurality of tension members encased within a jacket. One example includes steel cords as the tension members and a polyurethane material as the jacket.

Regardless of the type of load bearing assembly, elevator systems are typically designed with multiple load bearing members to provide adequate load supporting capacity and to meet appropriate safety codes. Typical arrangements include over-roping the system such that the total capacity of the load bearing assembly exceeds that required to satisfy the appropriate code. Over-roping with steel ropes was not typically a major concern. New, alternative load bearing members tend to be more expensive than steel ropes and, therefore, introduce new concerns in the context of over-roping an elevator system. More expensive load bearing members add increasing cost to elevator systems when the systems are over-roped.

There is a need for strategically roping an elevator system to more closely match the actual load carrying capacity of the load bearing assembly with the requirements for a particular system.

This invention addresses that need.

SUMMARY OF THE INVENTION

An exemplary disclosed load bearing assembly for use in an elevator system includes a plurality of load bearing members where at least one of the load bearing members has a different load carrying capacity then at least one other of the load bearing members.

One example system includes a plurality of flat belt load bearing members. At least one of the flat belts has a different load carrying capacity then at least one other of the flat belts.

In a disclosed example, the flat belts include a plurality of tension members encased within a jacket. At least one of the flat belts has a different number of tension members compared to at least one other of the flat belts.

With the disclosed examples, it becomes possible to more accurately rope an elevator system and, therefore, to avoid over-roping. The associated reduction in roping material costs provides significant cost savings associated with installing and maintaining elevator systems.

The various features and advantages of this invention will become apparent to those skilled in the art from the following detailed description of the currently preferred embodiment. The drawings that accompany the detailed description can be briefly described as follows.

DETAILED DESCRIPTION

Figure 1:
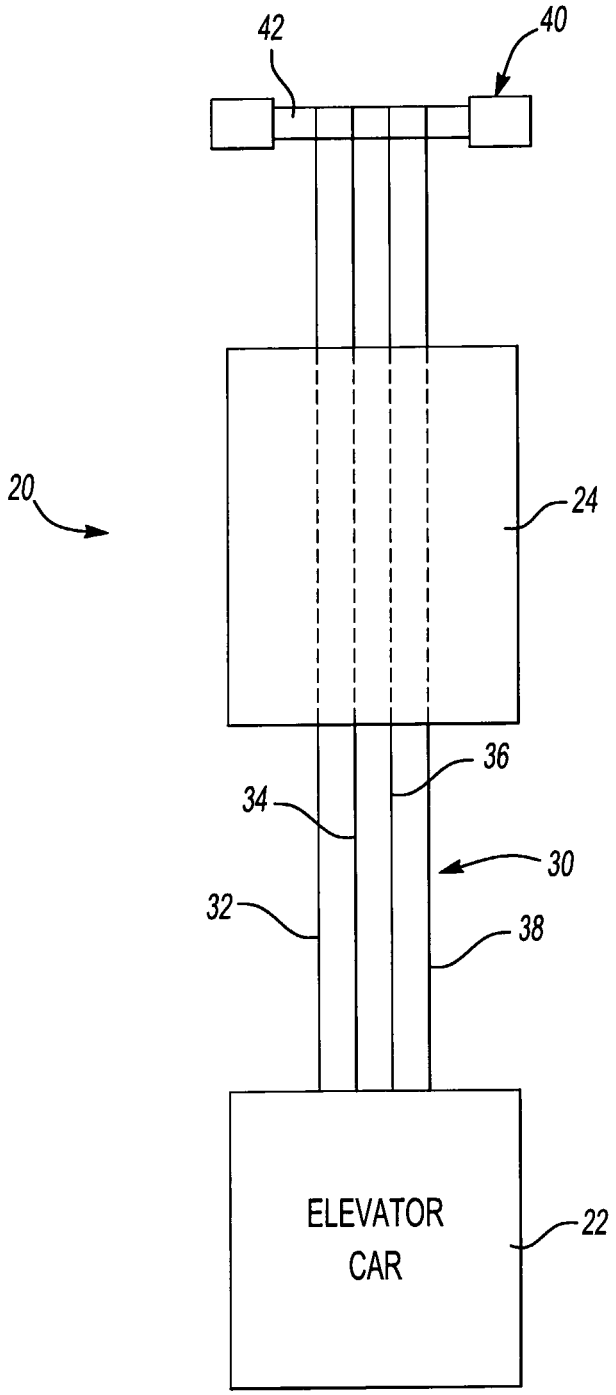
FIG. 1 schematically shows selected portions of an example elevator system incorporating a load bearing assembly designed according to an embodiment of this invention.

FIG. 1 schematically shows selected portions of an elevator system 20. An elevator car 22 and counterweight 24 are coupled together and supported by a load bearing assembly 30. The illustrated example includes a plurality of load bearing members 32, 34, 36 and 38. In one particular example, each load bearing member comprises a generally flat belt.

The load bearing assembly 30 supports the weight of the car 22 and the counterweight 24 as they move within a hoistway, for example. The illustrated example includes a drive mechanism 40 including at least one drive sheave 42 (sometimes referred to as a traction sheave) for moving the load bearing assembly 30 to cause the desired movement of the car 22 and the corresponding movement of the counterweight 24.

One feature of the illustrated example is that the individual load bearing members 32-38 are not all the same. In this example, at least one of the load bearing members 32-38 has a different load carrying capacity than at least one other of the load bearing members 32-38. Traditionally, load bearing assemblies have used the same size load bearing member throughout the entire assembly. In this example, at least one different-sized load bearing member is used to be able to customize the aggregate load carrying capacity of the entire load bearing assembly 30 to more closely meet the requirements for a particular elevator system.

Figure 2:
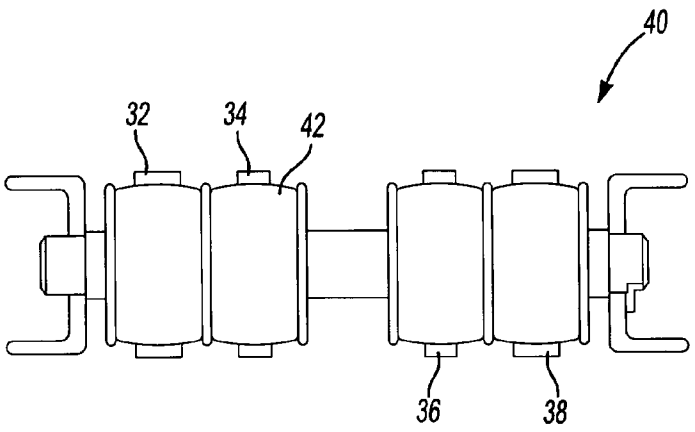
FIG. 2 schematically illustrates selected features of the embodiment of FIG. 1.

FIG. 2 schematically shows an example arrangement where the load bearing members 32 and 38 each have a first load carrying capacity. The load bearing members 34 and 36 each have a second, relatively lower load carrying capacity compared to that of the load bearing members 32 and 38. In one example, the load bearing members have load carrying capacities that are integer multiples of each other. In another example, a variety of increments in load carrying capacity are used for a more specific variety of aggregate load bearing assembly capacity. In one example, the load bearing members 32 and 38 have a 64 KN capacity while the load bearing members 34 and 36 each have a 32 KN capacity. In another example, there is an approximately 1:1.6 ratio between the capacities of the different sized load bearing members.

Using a ratio of approximately 1:1.6 between the different load carrying capacities provides the advantage of achieving a more precise match between the total load bearing member strength applied and the total strength required for a given elevator system. Table 1 illustrates an example range of possible total applied strengths in a range from 300 kN to 800 kN.

TABLE 1

| Total Strength | Number of 100 kN LBM | Number of 160 kN LBM |
|---|---|---|
| 300 | 3 | 0 |
| 360 | 2 | 1 |
| 400 | 4 | 0 |
| 420 | 1 | 2 |
| 460 | 3 | 1 |
| 480 | 0 | 3 |
| 500 | 5 | 0 |
| 520 | 2 | 2 |
| 560 | 4 | 1 |
| 580 | 1 | 3 |
| 600 | 6 | 0 |
| 620 | 3 | 2 |
| 640 | 0 | 4 |
| 680 | 2 | 3 |
| 700 | 7 | 0 |
| 740 | 1 | 4 |
| 800 | 0 | 5 |

As can be appreciated from Table 1, the strength ratio between the load bearing members (LBM) in the second column and those in the third column is 1:1.6. Using such a ratio between the load bearing capacities allows for selectively achieving each of the 17 total strengths shown in Table 1. If one were to design an elevator system including only one strength of belt, and 100 kN or 160 kN belts were the only options available, then only eight of the options in Table 1 are possible. If one were to select an integer multiple difference between belt strengths (e.g., 100 kN belts and 200 kN belts), then only six of the options shown in FIG. 1 are possible. Using a ratio between the load bearing capacities of the different sized load bearing members such as 1:1.6, therefore, provides significantly more freedom to be more precise in matching the load bearing capacity of a load bearing member assembly 30 and the actual requirements for an elevator system.

In the illustrated example of FIG. 2, there is an even number of load bearing members with each of the different capacities. Some examples include only one load bearing member with a different load carrying capacity compared to the others. Another example includes at least three different load carrying capacities among the load bearing members. In one example, each load bearing member has a different load carrying capacity. Given this description, those skilled in the art will be able to select an appropriate combination of load bearing members to meet the needs of their particular situation.

Figure 3:
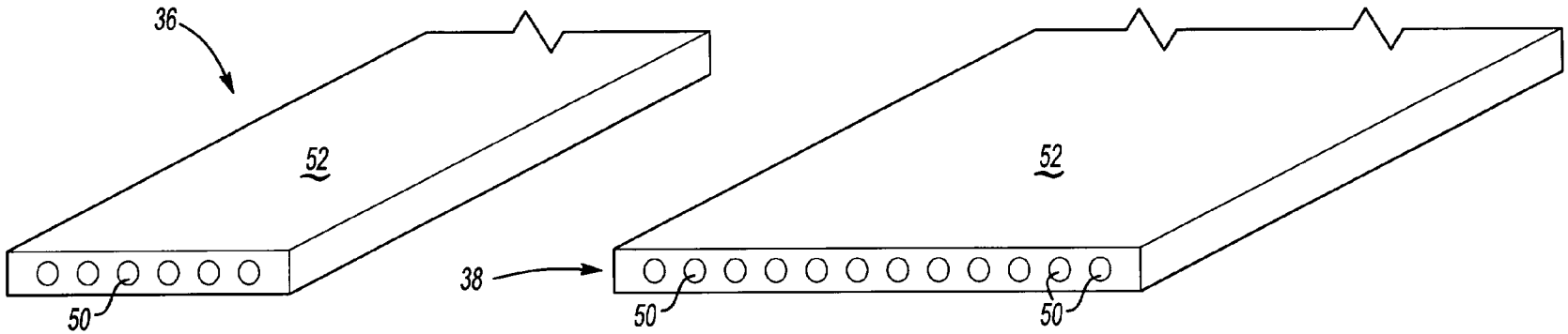
FIG. 3 schematically illustrates an example plurality of load bearing members useful within an example embodiment of this invention.

FIG. 3 schematically shows one example arrangement of the load bearing members 36 and 38. In this example, the load bearing member 36 has approximately one half the load carrying capacity of the load bearing member 38. Each load bearing member in this example has a plurality of tension members 50 encased within a jacket 52. One example includes steel cords as the tension members 50 and a polyurethane jacket 52. As can be appreciated from FIG. 3, the load bearing member 38 has twice as many tension members 50 as the load bearing member 36. The illustrated load bearing member 38 has twice the load carrying capacity of the load bearing member 36.

One advantage to the disclosed example is that by using flat belt load bearing members, no modification to the drive sheave is required even though different size load bearing members are used. In other words, the width of a belt does not have an impact on the diameter of the sheave required for driving the elevator system. Similarly, different width belts can follow the same sheave surface geometry so that no special sheave design or modification is required to accommodate different sized belts.

The same is not true of load bearing members that are not generally flat. For example, if one were to mix different sized steel ropes in an elevator system, different sized sheaves would be required for each differently sized rope, which is impractical. The sheaves would require different diameters and different groove configurations, for example, to accommodate the different sized ropes. Even "V" shaped grooves will not work well because the effective sheave diameter will vary as rope diameter varies among mixed ropes. One advantage of the illustrated example is that no modification to a drive sheave is required to accommodate the different sized load bearing members. This introduces further economies into an elevator load bearing assembly designed according to an embodiment of this invention.

One aspect of using different sized load bearing members includes maintaining the same stress level on each load bearing member. In traditional elevator systems, terminations typically include springs for adjusting the tension on each load bearing member. When all the load bearing members are the same, the same tension can be applied across the load bearing members to achieve an even distribution of stress. A conventional technique for achieving equal tension is to configure the terminations such that adjusting the springs to an equal length or equal height when installed achieves the desired equal tension. This allows an installer to visually observe the position of termination components to achieve the equal length required. In many instances, a position of the top of the spring of each termination preferably is aligned with the top of all other springs.

When introducing different sized load bearing members having different load bearing capacities, such a technique is not automatically available. Different sized load bearing members will require different tensions, for example. To facilitate installation of systems including embodiments of this invention, one example includes a modified termination arrangement to accommodate the different sized load bearing members while maintaining convenience for system installers or maintenance personnel.

Figure 4A:
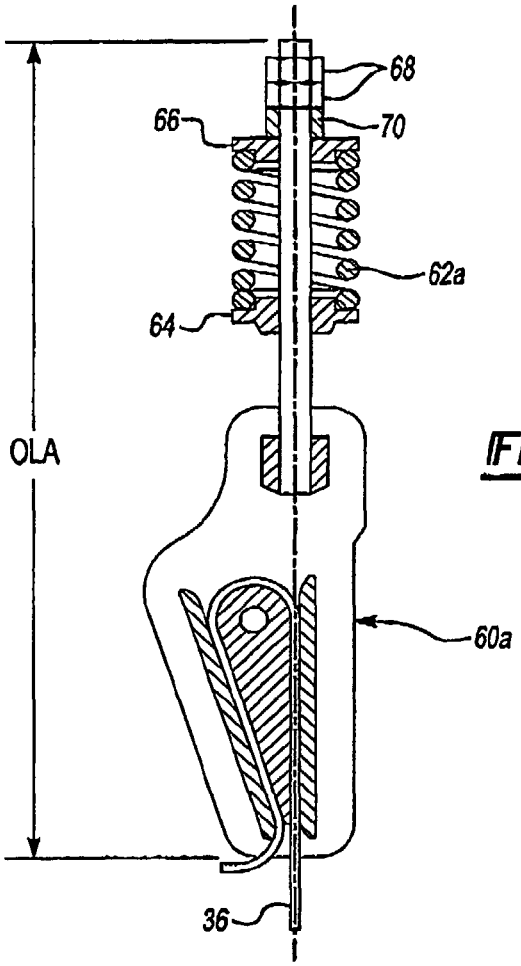
FIGS. 4*a* and 4*b* illustrate example terminations useful in one embodiment of this invention.
Figure 4B:
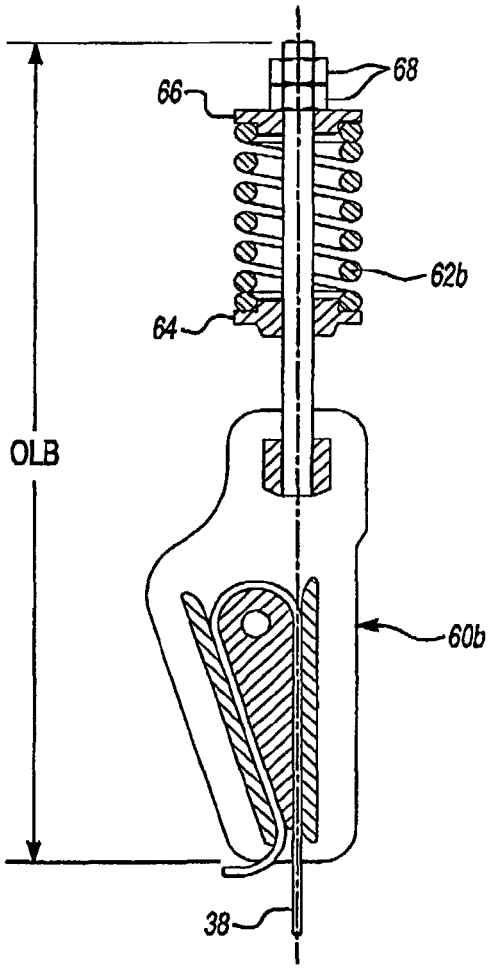

FIGS. 4*a* and 4*b* show example terminations 60*a* and 60*b*, respectively. In this example, the termination 60*a* is useful with the load bearing member 36, which has a 100 kN capacity in one example. The termination 60*b* is useful with the load bearing member 38, which has a load carrying capacity of 160 kN in the same example. The terminations 60*a* and 60*b* work in a known manner for securing an end of the corresponding load bearing member with respect to a selected structure within the elevator system. Each termination includes a spring for adjusting the tension on the corresponding load bearing member. The spring rates of the spring 62*a* and the spring 62*b* are different and proportional to the load carrying capacity of the corresponding load bearing members. It follows that the adjustment of the springs 62*a* and 62*b* will not automatically provide an equal length if they are properly adjusted to achieve the desired tension on the load bearing members.

In the illustrated examples, each spring is contained between bushings 64 and 66. Manually manipulating nuts 68 in a known manner adjusts the position of the bushing 66 relative to the bushing 64 to adjust tension.

In this example, the spring 62*b* is longer than the spring 62*a* when the desired tension is set on that spring. Given that the terminations 60*a* and 60*b* have an equal overall length (e.g., OAL=OLB), the tops (according to the drawings) of the springs 62*a* and 62*b* will not be aligned with each other assuming that the terminations are aligned in a known manner. The illustrated example includes a spacer 70 provided with the termination 60*a* to change the position of the nuts 68 relative to the bushing 66. Spacer 70 makes up the difference in length between the springs 62*a* and 62*b* such that the nuts 68 on the termination 60*a* are in the same position (vertically in the drawings) as the position of the nuts 68 on the termination 60*b* when both terminations are adjusted to the desired tension. This example allows an installer or maintenance technician to visually confirm that the position of the nuts 68 are aligned on the terminations 60*a*, 60*b* to confirm that the tensions on each of the load bearing members are set to a desired level.

Given the different sizes of the different load bearing members, the different sizes or spring rates of the different springs and the desired tension on each load bearing member, the size of the spacer 70 required to achieved the desired alignment of the nuts 68 can be determined beforehand. Appropriately sized spacers 70 can then be included on the appropriate terminations during manufacturing or installation, for example. The illustrated example allows for conveniently achieving the tensions required to accommodate the different sized load bearing members while, at the same time, providing the convenience that elevator system installers and maintenance personnel are accustomed to when adjusting terminations.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a traction sheave;

an elevator car;

a counterweight;

a load bearing assembly coupling the elevator car and the counterweight, the load bearing assembly including a plurality of flat belts including at least one flat belt having a different load carrying capacity than at least one other of the flat belts, the plurality of flat belts supporting a load of the elevator car and the counterweight, the plurality of flat belts being moved by the drive sheave to cause movement of the elevator car and the counterweight;

a first termination associated with the one flat belt and having a spring for establishing a first tension on the one flat belt;

a second termination associated with the at least one other flat belt having a spring for establishing a second, different tension on the at least one other flat belt;

wherein:

the spring of the first termination has a first length when the first tension is established;

the spring of the second termination has a second, shorter length when the second tension is established; and the second termination includes a spacer member that has a length corresponding to a difference between the first and second lengths.

2. The assembly of claim 1, wherein each termination includes an adjusting member near one end of the termination for adjusting the corresponding tension on the associated flat belt and wherein the adjusting member of the first termination is aligned with the adjusting member of the second termination when the first and second tensions are established.

3. A load bearing assembly for use in an elevator system, comprising:

a plurality of load bearing members, at least one of the load bearing members having a load carrying capacity that is different than a load carrying capacity of at least one other of the load bearing members;

a first termination associated with the one load bearing member and having a spring for establishing a first tension on the one load bearing member, the spring of the first termination has a first length when the first tension is established;

a second termination associated with the at least one other load bearing member having a spring for establishing a second, different tension on the at least one other load bearing member, the spring of the second termination has a second, shorter length when the second tension is established, the second termination includes a spacer member that has a length corresponding to a difference between the first and second lengths;

wherein the difference between the first and second tensions corresponds to a difference in the load carrying capacities of the associated load bearing members; and wherein each termination includes an adjusting member near one end of the termination for adjusting the corresponding tension on the associated load bearing member and wherein the adjusting member of the first termination is aligned with the adjusting member of the second termination when the first and second tensions are established.

* * * * *